US005338442A

United States Patent [19]

Siskin et al.

[11] Patent Number: 5,338,442

[45] Date of Patent: Aug. 16, 1994

[54] PROCESS FOR CONVERTING AND UPGRADING ORGANIC RESOURCE MATERIALS IN AQUEOUS ENVIRONMENTS

[75] Inventors: Michael Siskin, Livingston, N.J.; Alan R. Katritzky, Gainesville, Fla.; Glen B. Brons, Phillipsburg, N.J.

[73] Assignee: Exxon Research & Engineering Co., Florham Park, N.J.

[21] Appl. No.: 852,438

[22] Filed: Mar. 16, 1992

Related U.S. Application Data

[63] Continuation-in-part of Ser. No. 411,121, Sep. 22, 1989, abandoned.

[51] Int. Cl.[5] ..... C10G 1/04

[52] U.S. Cl. ..... 208/435; 208/113; 208/391; 208/400; 208/415; 208/430

[58] Field of Search ..... 208/391, 400, 415, 430, 208/435, 428, 113; 166/272, 275; 423/652, 415, DIG. 20

[56] References Cited

U.S. PATENT DOCUMENTS

| | | | |
|---|---|---|---|
| 3,556,981 | 1/1977 | Cymbalisty | 208/391 |
| 3,586,621 | 6/1971 | Pitchford | 208/112 |
| 3,679,577 | 7/1972 | Wantland | 208/430 |
| 3,796,650 | 3/1974 | Urban | 208/391 |
| 3,848,755 | 4/1976 | McCollum et al. | 208/391 |
| 3,918,521 | 11/1975 | Snavely, Jr. et al. | 166/303 |
| 3,948,754 | 4/1976 | McCollum et al. | 208/251 R |
| 3,988,238 | 10/1976 | McCollum et al. | 208/391 |
| 4,005,005 | 1/1977 | McCollum et al. | 208/391 |
| 4,120,358 | 10/1978 | Kalfoglou | 166/272 |
| 4,120,776 | 10/1978 | Miller et al. | 208/391 |
| 4,120,777 | 10/1978 | Globus | 208/391 |
| 4,158,638 | 6/1974 | Tsai | 166/272 |
| 4,187,185 | 2/1980 | Park et al. | 166/272 |
| 4,201,656 | 5/1980 | Sanford | 208/391 |
| 4,223,730 | 9/1980 | Schulz et al. | 166/272 |
| 4,271,905 | 6/1981 | Redford et al. | 166/272 |
| 4,331,532 | 5/1982 | Bose | 208/391 |
| 4,438,816 | 3/1984 | Urban et al. | 166/303 |
| 4,456,066 | 6/1984 | Shu | 166/272 |
| 4,533,459 | 8/1985 | Dente et al. | 208/391 |
| 4,584,088 | 4/1986 | McCollum et al. | 208/391 |
| 4,668,380 | 5/1987 | Wolff et al. | 208/430 |
| 4,730,673 | 3/1988 | Bradley | 166/272 |

*Primary Examiner*—Helane Myers

*Attorney, Agent, or Firm*—Linda M. Scuorzo; Maurice L. Williams

[57] ABSTRACT

The invention is a process for the aqueous conversion and upgrading of organic resource materials carried out by contacting organic resource materials selected from the group consisting of coal, shale, coal liquids, shale oil, and bitumen with liquid water in the absence of externally supplied hydrogen or reducing agents, controlling the temperature in the range from above about 200° C. to below the critical temperature of water to maintain water in a liquid phase, wherein the pressure is the corresponding vapor pressure (autogenous pressure) of the system, for a time sufficient to effect the conversion and upgrading process. Additionally, the contacting may be conducted in the presence of a catalyst selected from the group consisting of a brine catalyst, clay catalyst and mixtures thereof.

13 Claims, No Drawings

PROCESS FOR CONVERTING AND UPGRADING ORGANIC RESOURCE MATERIALS IN AQUEOUS ENVIRONMENTS

CROSS-REFERENCE TO RELATED APPLICATIONS

This is a continuation-in-part of U.S. application Ser. No. 411,121 filed Sep. 22, 1989 now abandoned.

BACKGROUND OF THE INVENTION

Transformations of organic compounds in aqueous environments are both of considerable intrinsic interest and of great economic importance. Most of the world's fuel sources and synthetic fuel precursors have been naturally formed and modified under such conditions. The potential economic incentives for converting and upgrading organic-containing resource materials by aqueous rather than conventional hydrogen treatments is enormous. Despite the scientific and economic importance, available work on reactions of organic resource materials in water at temperatures from above about 200° C. to below the critical temperature of water has been sparse and fragmentary.

The potential reserves of liquid and gaseous hydrocarbons contained in subterranean deposits are known to be substantial and form a large portion of the known energy reserves in the world. It is desirable, from an economic standpoint, to use coal and shales, for example, to produce both liquid and gaseous fuels, since both are relatively inexpensive compared to petroleum crude oil, and are quite abundant in contrast to our rapidly dwindling domestic supply of crude oil. As a result of the increasing demand for light hydrocarbon fractions, there is much interest in economical methods for recovering liquids and gases from coal and shale on a commercial scale. Various methods for recovering liquids and gases from these resources have been proposed, but the principal difficulty with these methods is that the processes are complicated and expensive, which renders the products derived therefrom too expensive to compete with products derived from petroleum crudes recovered by less expensive conventional methods.

Moreover, the value of liquids recovered from coals and shales is diminished due to the presence of high concentrations of contaminants in the recovered liquids. The chief contaminants are sulfur- and nitrogen-containing compounds which cause detrimental effects to the various catalysts utilized in these processes. These contaminants are also undesirable because of their disagreeable odor, corrosivity and undesirable combustion products.

Additionally, as a result of the increasing overall demand for light hydrocarbon fractions, there is much interest in more efficient methods for converting the heavier liquid hydrocarbon fractions recovered from coal and shale reserves into lower molecular weight materials. Conventional methods for converting these materials, such as catalytic hydrocracking, coking, thermal cracking and the like, result in the production of less desirable, high refractory materials.

During hydrocracking, hydrocarbon fractions and refractory materials are converted into lower molecular weight in the presence of hydrogen. Hydrocracking processes are more commonly employed on coal liquids, shale oils, or heavy residual or distillate oils for the production of substantial yields of low boiling saturated products and to some extent of intermediates which are utilizable as domestic fuels, and still heavier cuts which find uses as lubricants. These destructive hydrogenation processes or hydrocracking processes are operated on a strictly thermal basis or in the presence of a catalyst.

However, the application of the hydrocracking technique has in the past been fairly limited because of several interrelated problems. Conversion by hydrocracking of heavy hydrocarbon fractions recovered from coal or shale into more useful products is complicated by contaminants present in the hydrocarbon fractions. Oils extracted from coal can contain exceedingly large quantities of higher molecular weight sulfur compounds. The presence of these sulfur compounds in crude oils and various refined petroleum products and hydrocarbon fractions has long been considered undesirable. Similarly, oils produced from shales also contain undesirable nitrogen compounds in exceedingly large quantities.

For example, because of the disagreeable odor, corrosive characteristics and combustion products of sulfur- and nitrogen-containing compounds (particularly sulfur- and nitrogen-dioxide), their removal has been of constant concern to the petroleum refiner. Further, the heavier hydrocarbons are largely subjected to hydrocarbon conversion processes in which the conversion catalysts are, as a rule, highly susceptible to poisoning by sulfur and nitrogen compounds. This has, in the past, led to the selection of low-sulfur and low-nitrogen hydrocarbon fractions whenever possible. With the necessity of utilizing heavy, high sulfur and high nitrogen hydrocarbon fractions in the future, economical heteroatom removal (desulfurization and denitrogenation) processes are essential. This need is further emphasized by recent and proposed legislation which seeks to limit sulfur contents of industrial and motor fuels.

Generally, organic sulfur appears in feedstocks as mercaptans, sulfides, disulfides, or as part of complex ring compounds. The mercaptans are more reactive and are generally found in the lower boiling fractions; for example, gasoline, naphtha, kerosene, and light gas oil fractions. There are several well-known processes for sulfur removal from such lower boiling fractions. However, sulfur removal from higher boiling fractions has been a more difficult problem. Here, sulfur is present for the most part in less reactive forms as sulfides, and as part of complex ring compounds of which thiophene is a prototype. Such sulfur compounds are not susceptible to the conventional chemical treatments found satisfactory for the removal of mercaptans and are particularly difficult to remove from heavy hydrocarbon materials. Organic nitrogen appears in feedstocks as amines or nitriles or as part of complex ring compounds such as pyridines, quinolines, isoquinolines, acridines, pyrroles, indoles, carbazoles and the like. Removal of nitrogen from the more complex heterocyclic aromatic ring systems using conventional catalysts is particularly difficult.

In order to remove the sulfur and nitrogen and to convert the heavy residue into lighter more valuable products, the heavy hydrocarbon fraction is ordinarily subjected to a hydrocatalytic treatment. This is conventionally done by contacting the hydrocarbon fraction with hydrogen at an elevated temperature and pressure and in the presence of a catalyst. Unfortunately, unlike lighter distillate stocks which are substantially free from asphaltenes and metals, the additional presence of asphaltenes, which contain heavy and polar nitrogen and sulfur compounds, and metal-containing compounds, which contain heavy nitrogen species, leads to a relatively rapid reduction in the activity of the catalyst to below a practical level. The presence of these materials in the feedstock results in a reduction in catalyst activity. Eventually, the on-stream period must be interrupted, and the catalyst must be regenerated or replaced with fresh catalyst.

Aside from these technologies, conventional processes are also known to externally supply hydrogen or reducing agents to the organic resource material. In addition, these processes may also operate above the critical temperature of water or at pressures of at least 1000 psig. Conversion of organic resource materials under these conditions is known as dense fluid or gas extraction and is not the subject of applicant's inventions.

U.S. Pat. No. 3,988,238 (1976) to McCollum et al., discloses a dense-fluid extraction process for recovering liquids and gases from bituminous coal solids and desulfurizing the recovered liquids. The process is carried out in the absence of externally supplied hydrogen and the coal is contacted with a water-containing fluid at a temperature in the range of 600° F. (315° C.) to 900° F. (485° C.). However, the process requires externally supplied pressure as well as the presence of an externally supplied sulfur resistant transition metal catalyst. Applicants process does not require the presence of any externally supplied catalyst, although optionally, a catalyst may be present. However, that catalyst must be a brine or clay (i.e., layered aluminosilicates) catalyst or mixtures thereof, and is thus distinguishable from '238.

U.S. Pat. No. 4,005,005 discloses a dense fluid extraction process for recovering liquids and gases that does not require the presence of an externally supplied catalyst. It discloses and claims a reaction temperature range of 600° F. (315° C.) to 900° F. (485° C.), but all reactions were run at supercritical temperatures i.e., 710° F. (377° C.), which is above the critical temperature of water, 705° F./375° C. (reactions run below the critical temperature of water were at pressures that produce steam rather than liquid water). Most importantly, the process in '005 operates on tar sands while applicants process converts and upgrades organic resource materials selected from the group consisting of coal, shale, coal liquids, shale oils, heavy oils, and bitumens, preferably coal, shale, coal liquids, and shale oils, more preferably coal and shale, using liquid water and the corresponding autogeneous vapor pressure of the system at a temperature from about 200° C. (392.0° F.) to below the critical temperature of water, 374.4° C. (705° F.) more preferably from about 250° C. to about 370° C., most preferably from about 250° C. to about 350° C.

The above-mentioned methods do not disclose applicants process for "converting" and "upgrading" organic resource materials (as the terms are defined herein) in liquid water, in the absence of externally supplied hydrogen or other reducing agents or externally supplied catalysts, at temperatures from above about 200° C. at the corresponding vapor pressure (i.e., at autogenous pressure of the system), to produce more desirable value added materials i.e., products that have lower molecular weights or increased extractability.

SUMMARY OF THE INVENTION

It has now been found that organic molecules react largely by ionic pathways in aqueous systems, as opposed to free radical pathways in nonaqueous systems at high temperatures. This reaction mechanism is due in part to favorable changes that occur in the chemical and physical properties of liquid water at temperatures below the critical temperature of water. These changes are manifest by water that has a higher dissociation constant, a lower density, and a lower dielectric constant. These properties generally increase the solubility of organics in water and help facilitate the ionic pathways in aqueous systems.

Therefore, the invention relates to processes that characteristically occur in solution rather than in a typical pyrolytic process. It has also been found that many ionic pathways are further catalyzed in the presence of brine or clay, which act to stabilize the ionic intermediates or transition states formed during conversion and thereby help to further enhance the acidic or basic chemistries of the water.

In view thereof the invention is a process for the aqueous conversion and upgrading of organic resource materials to produce more desirable, value added materials, wherein the organic resource materials are selected from the group consisting of coal, shale, coal liquids, shale oils, heavy oils and bitumens, preferably coal, shale, coal liquids, and shale oils, more preferably coal and shale comprising adding the organic resource material to liquid water, preferably neutral water (pH about 7), in the absence of externally supplied hydrogen, reducing agents, catalysts or pressure and controlling the temperature in the range from above about 200° C. to below the critical temperature of water (374.4° C.) to maintain water in a liquid phase wherein the pressure is the corresponding i.e., autogenous vapor pressure, for a time sufficient to effect the conversion and upgrading process. Additionally, the contacting may be conducted in the presence of catalysts selected from the group consisting of a brine catalyst, clay catalyst and mixtures thereof.

DETAILED DESCRIPTION

Conversion, as used herein, is defined as C—C bond ruptures in paraffins, olefins and aromatic hydrocarbon groups of organic resource materials; C—N, C—O and C—S bond ruptures in paraffinic, olefinic and aromatic heteroatom containing groups of an organic resource materials to produce more desirable value added materials. The degree of conversion is manifested, for example, by products having increased extractability, lower boiling points and lower molecular weights. Therefore, conversion products of the invention include a complex hydrocarbon mixture resulting from depolymerization of the organic resource materials and which is depleted in heteroatom containing species relative to the starting organic resource materials. Acidic and basic products generated during conversion include, for example, acetic acid, carbon dioxide, ammonia, phenols and water soluble inorganics.

Upgrading, as used herein, is defined as the modification of organic resource materials to desirable value added products by, for example, the removal of nitrogen, sulfur and oxygen contaminants present, for example, in the form of ammonia, amines, nitriles, mercaptans, hydrogen sulfide and water, etc.

Oxidizing and reducing agents generated during the conversion process may include, for example, formic acid, formaldehyde, hydrogen sulfide, sulfur, sulfur dioxide, sulfur trioxide, oxygen, carbon monoxide, etc. as specified above.

Organic resource materials as used herein means organic resource materials selected from the group consisting of coal, shales, heavy oils, bitumens, coal liquids and shale oils. Preferred are solid coal, shale, coal liquids, and shale oil, more preferred are coal and shale.

The complex, heterogeneous and insoluble nature of coal and of shale precludes a detailed knowledge of their exact chemical structures. Although coal and shale are polymeric, or more specifically contain macromolecular network structures comprising a number of structural units, it is believed that no two structural units are repeated, which further adds to the complexity of analyzing the solids. Consequently, it is exceedingly difficult to use existing analytical tools to develop a comprehensive structure that portrays the precise molecular bonding of their infinite network structures. In an effort to gain some insight into the structure of these materials, numerous authors have developed models which depict representative structures. For example, solid coal has been shown to contain aromatic groups cross-linked by various bridges along with an array of various other structural units. See Shinn, J. H., *From Coal to Single-Stage and Two Stage Products: A Reactive Model of Coal Structure*, Fuel Vol. 63, p. 1187 (1984), C. G. Scouten et al., *Detailed Structural Characterization of the Organic Material in Rundle Ramsay Crossing Oil Shale*, Prep. Pap. A.C.S. Div. Petroleum Chem., Vol. 34, p. 43 (1989), and M. Siskin et al, *Disruption of Kerogen-Mineral Interactions in Oil Shales*, Energy & Fuels, Vol. 1, p. 248–252 (1987). The structural units have been largely identified from a detailed analysis of liquefied products. Models are not only valuable for determining the various types and relative amounts of structural units present, but also provide valuable clues for predicting how these structures are connected and are likely to react. For instance, it is known that most reactive cross-links are broken by thermal treatments, such as coal liquefaction, under mild conditions. Furthermore, it is also known that by further increasing the temperature and residence time of a reaction, the formed products undergo additional reactions which may also be modeled. Model compounds representative of coal, shale and other resource materials can be used to illustrate depolymerization reactions. Otherwise, reaction results are masked by complicated, and in most instances, incomplete product analysis. For experimental purposes, model compounds are preferred, as long as they comprise the structural units involved in the reaction chemistry.

In one aspect, the invention involves a process for converting and upgrading organic resource materials using liquid water at autogenous pressures. Specifically, the invention is a process for the aqueous conversion and upgrading of organic resource materials to produce more desirable, value added materials, wherein the organic resource materials are selected from the group consisting of coal, shale, coal liquids, shale oils, heavy oils and bitumens, preferably coal, shale, coal liquids, and shale oils, more preferably coal and shale comprising contacting the organic resource material with liquid water, preferably neutral water (pH about 7), in the absence of externally supplied, hydrogen, reducing agents, pressure, and controlling the temperature in the range from above about 200° C. to below the critical temperature of water, 374.4° C., to maintain water in a liquid phase, more preferably from about 250° C. to about 370° C., most preferably from about 250° C. to about 350° C., wherein the pressure is the corresponding vapor pressure (i.e., autogenous pressure of the system), for a time sufficient to effect the conversion and upgrading process. Additionally, the contacting may be conducted in the presence of at least one catalyst selected from the group consisting of a brine catalyst, clay catalyst, i.e., layered alumino-silicates, and mixtures thereof.

In the present invention the process pressure is the corresponding vapor pressure (i.e., autogenous pressure) at the contacting temperature (i.e., from about 200° C. to just below 374.4° C.), the critical temperature of water in order to maintain water in a liquid phase. The corresponding vapor pressure needed to maintain liquid water in the process of applicants' invention ranges from about 225 psi at 200° C. to about 1532 psi at 350° C. to about 3199.6 psi at 374° C. Such values are readily determinable by one ordinarily skilled in the art with reference to standard texts such as the CRC Handbook of Chemistry and Physics, 61st Edition, page D-197 (1980–1981). Thus, in applicants' process the process pressure within the specified range of process temperatures corresponds essentially to the vapor pressure of water plus in a minor or lesser part to the vapor pressure of the more volatile depolymerized products and gases (which is equivalent to the autogenous pressure of the system).

In another aspect, the invention involves a process wherein water soluble conversion products (i.e., hydrolysis products), include acidic products, basic products, reducing agents and oxidizing agents, that effect further conversion and upgrading of the organic resource materials. Therefore, recycle enrichment of these materials present another viable processing option.

The water employed in the process is preferably substantially free of dissolved oxygen to minimize the occurrence of any undesirable free radical reactions. As a starting material the water is liquid water, preferably neutral liquid water (pH about 7). The contacting temperature for the organic resource material and water ranges from above about 200° C. to below the critical temperature of water (374.4° C.). Preferably the temperature ranges from about 200° C. to less than 374.4° C., more preferably from about 250° C. to about 370° C., most preferably from about 250° C. to about 350° C. The contacting is preferably for a period of time ranging from about 5 minutes to about one week, more preferably from about 30 minutes to about 6 hours, and most preferably 30 minutes to 3 hours. We have found that the reactivity of the organic resource materials will occur in water present in any amount. While not wishing to be bound by any theory, it is believed that certain weight ratios of water to organic resource material, drives the reaction at faster rates. Therefore, a weight ratio of water to organic resource material in the range from about 0.5 to about 10 is preferred, and more preferably from about 0.5 to 5.0, most preferably 0.5 to 2. The maximum particle diameter of the solids is preferably about 100 Tyler mesh to about 0.25 inches and more preferably is about 60 to about 100 Tyler mesh.

The brine or clay catalyst is preferably present in a catalytically effective amount and may, for example, be an amount equivalent to a concentration in the water in the range of from about 0.01 to about 50 weight percent, preferably from about 0.1 to about 10 weight percent, and most preferably 0.1 to 5 weight percent. The brine or clay catalyst may be added as a solid slurry or as a water-soluble reagent to the reaction mixture.

Brine catalysts, as defined herein, are salt solutions with cations selected from the group consisting of Na, K, Ca, Mg, Fe and mixtures thereof. More preferably, the cations are selected from Na, Ca, Fe and mixtures thereof. The anion of the salt is any water soluble anion bondable with the cation which does not produce a strongly basic solution. Clay catalysts, as defined herein, are catalysts selected from the group consisting of smectitic or illitic clays (i.e., layered aluminosilicates), or mixtures thereof.

When the method of this invention is performed above ground with mined coal, for instance, the desired products can be recovered more rapidly if the mined solids are ground to form smaller particle sizes. Alternatively, the method of this invention can be performed in situ on subterranean deposits by pumping water, or water containing clay and/or brine into the deposits and withdrawing the recovered products for separation or further processing.

Alternatively, catalyst components can be deposited on a support and used as such in a fixed-bed flow configuration or slurried in water. This process can be performed either as a batch process or as a continuous or semi-continuous flow process. The residence times in a batch process or inverse solvent space velocity in a flow process are preferably on the order of from 30 minutes to about 3 hours for effective conversion and upgrading of recovered products.

To circumvent mass transport limitations, the organic resource materials may be pretreated prior to contact with the catalyst. For example, oil shale is demineralized when treated with aqueous HCl and HF. Other pretreatment methods commonly known and employed in the art may also be used. Where the conversion products are extractable, extraction solvents may include, for example, tetrahydrofuran (THF), pyridine, toluene, naphtha and any suitable solvents generated in the conversion process. Those skilled in the art will be aware of other extraction solvents that may be used.

Having described the invention, the following are examples which illustrate the various workings of it. They are not intended to limit the invention in any way.

EXAMPLES

General Procedures—Examples 1 through 13

A model compound (1.0 g, high purity) was charged into a glass-lined, 22 ml, 303SS Parr bomb. Deoxygenated water (7.0 ml) or deoxygenated brine (7.0 ml) (containing 10 wt. % sodium chloride) was freshly prepared by bubbling nitrogen into distilled water for 1 to 1.5 hours in clay (1.0 g). The distilled water was then charged into the nitrogen blanketed reactor vessel and sealed. In some cases, 7.0 ml of an inert organic solvent, e.g., decal in or cyclohexane (7.0 ml) were used as the thermal control agent to differentiate the results of aqueous chemistry from thermal chemistry. The reactor was then placed into a fluidized sand bath set at the required temperature for the required time. After the residence period, the reaction vessel was removed and allowed to cool to room temperature and later opened under a nitrogen atmosphere.

Analysis—Examples 1 through 13

The entire mixture was transferred to a jar containing a Teflon stir bar. The walls of the glass liner and bomb cup were rinsed with 10 ml of carbon tetrachloride or diethyl ether. This was added to the reaction mixture in the jar. After blanketing the jar with nitrogen and sealing it with a Teflon-lined cap, the entire mixture was stirred overnight at ambient temperature. Afterwards, the stirrer was stopped and the phases that developed were allowed to separate. If after overnight stirring, diethyl ether or carbon tetrachloride insoluble solids were found, the entire mixture was centrifuged at 2000 rpm for 30 minutes in a tube sealed under nitrogen to aid in the separation and recover solids. The centrifugation prevents losses of volatile materials which otherwise might have been lost during filtration. The organic layer was pipetted from the aqueous layer and analyzed by infrared spectroscopy, gas chromatography and mass spectroscopy. The pH and final volume of the aqueous layer was also measured before analyzing for total organic carbon (TOC) and ammonium ion, where nitrogen compounds were used. If solids did form, they were analyzed by infrared spectroscopy, thermal gravimetric analysis (TGA) and elemental analysis.

EXAMPLE 1 p-Phenoxyphenol, an aromatic ether, was reacted separately in water and decalin for 2 hours at 343° C. to give phenol (62% in water and 2% in decalin), isomeric phenoxyphenols (4%), 4,4'-dihydroxybiphenyl (9%) and dibenzofuran (5.5% in water) as major products. The water conversion was 85% and the decalin conversion was 2%. The results illustrate that ether cleavage, a reaction critical to depolymerization of resource materials, is effected in water by an ionic mechanism; however, this same cleavage pathway is not available by thermal, or free radical mechanisms.

EXAMPLE 2

Methyl naphthoate, an ester of an aromatic acid, was reacted in water at 343° C. for 2 hours to give naphthalene (33%) and 1-naphthoic acid (61%). There was no reaction in decalin under identical conditions. The results illustrate that esters are hydrolyzed or depolymerized under aqueous conditions, even though they are not reactive under thermal conditions.

EXAMPLE 3

Benzyl acetate, an ester of an aliphatic acid, was reacted in water at 250° C. for 5 days to give quantitative conversion to benzyl alcohol and acetic acid. The benzyl alcohol product undergoes slow conversion (4%) under these conditions. When one mole equivalent of acetic acid—similar to that generated in the original reaction of benzyl acetate—is added to the benzyl alcohol reaction mixture, the benzyl alcohol quantitatively reacts in 1.5 days. The results illustrate that acetic acid produced in the benzyl acetate hydrolysis can autocatalyze the reaction of the benzyl alcohol. Analogously, the presence of soluble acids produced in the reactor from the pores of source rock kerogens would autocatalyze the hydrolysis and other reactions that take place. However, the autocatalysis there would occur at much slower rates.

EXAMPLE 4

Cyclohexyl phenyl ether (X=O), cyclohexyl phenyl sulfide (X=S) and N-cyclohexylaniline (X=NH) were each reacted separately in (a) water, (b) a brine solution, (c) water containing a clay mineral (calcium montmorillonite), (d) a brine solution containing a clay mineral (calcium montmorillonite) and finally (e) decalin used as a thermal control agent. The results are summarized in Table 1.

TABLE 1

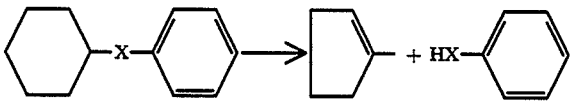

(Eq. 1)

| X | (a) $H_2O$ | (b) BRINE | (c) $H_2O$ + CLAY | (d) BRINE + CLAY | (e) THERMAL |
|---|---|---|---|---|---|
| —O— | 8.7 | 40.5 | 99.3 | 99.5 | 5.0 |
| —S— | 35.9 | 47.6 | 37.0 | 46.5 | 13.8 |
| —NH— | 4.0 | 6.2 | 60.4 | 89.0 | 3.6 |

The results show that cyclohexyl phenyl ether (X=O) is converted to methylcyclopentene and phenol. The methylcyclopentene is the isomerized form of cyclohexene indicating that cleavage of the ether bond takes place by an ionic mechanism. Water acts as an acid catalyst. When the same reaction is carried out in a brine solution, the ionic chemistry is facilitated. The salt stabilizes the ionic intermediate in the reaction and the conversion is increased from 8.7% to 40.5%. Since the reaction is acid catalyzed, the addition of calcium montmorillonite (clay) causes the reaction to go to 99.3% completion in 5.5 days and the effect of brine cannot be distinguished in this case. Thermally, in decalin a conversion of only 5% is obtained.

Cyclohexyl phenyl sulfide (X=S) was responsive to brine catalysis, but because sulfur is a softer base than oxygen, it did not interact with the clay in the clay and brine solution. The conversion in water or clay is substantially identical to systems where water has been added. Again, the thermal reaction in decalin is not as effective as the ionic pathway of the aqueous systems.

N-Cyclohexylamine (X=NH) showed a small amount of brine catalysis, but because nitrogen is a much stronger base than oxygen or sulfur, there was a more dramatic effect on acid catalysis when clay was present in the aqueous reaction mixture.

EXAMPLE 5

Pyridine-3-carboxaldehyde reacts in water to form pyridine and formic acid as major products. This ionic reaction all but ceases in cyclohexane, confirming that thermal, or free radical, chemistry is taking place. The reaction is strongly inhibited by the addition of 3-methylpyridine, unaffected by formaldehyde, and strongly catalyzed by phosphoric acid. The reaction sequence in Equation 2 helps to explain this behavior.

(Eq. 2)

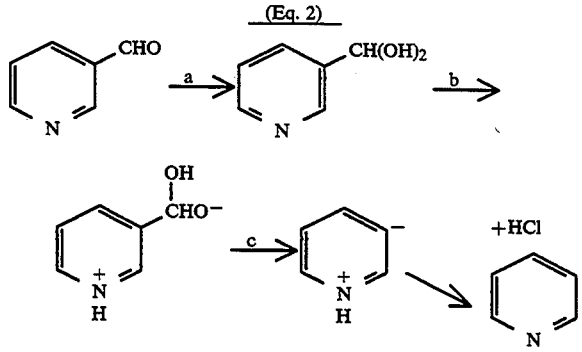

Water is needed for step (a), the hydration of the starting aldehyde. In the presence of added 3-methylpyridine, a stronger base than the hydrated aldehyde, the pyridine nitrogen would not become protonated in step (c). This protonation is strongly enhanced in an acidic media, such as phosphoric acid.

A considerable amount of 3-methylpyridine is produced from pyridine-3-carboxaldehyde and water with small amounts of 3-pyridylcarbinol (2.1%). The major source of 3-methylpyridine is via a reduction reaction by the formic acid formed in equation 2. The reaction strongly supports the production of 3-methylpyridine (44.8%) as formed by pyridine-3-carboxaldehyde and added formic acid. The reduction in the amount of pyridine formed from pyridine-3-carboxaldehyde in the presence of formic acid is not due to the inhibition of the reaction, but the rapid reduction of pyridine-3-carboxaldehyde to 3-pyridylcarbinol and hence to 3-methylpyridine. This behavior is even more pronounced when the experiment is carried out at 200° C. for 24 hours. In the pyridine-3-carboxaldehyde and formaldehyde experiments, the reduction, although slower, is not suppressed at 250° C. However, at 200° C., a large amount of 3-pyridylcarbinol is formed by reduction of the pyridine-3-carboxaldehyde by formaldehyde.

The results in Table 2 show that ionic and acid catalysis chemistries occur in aqueous systems. In addition, the presence of molecules such as formic acid and formaldehyde, generated during the reaction, act as reducing agents. As such, they have the ability to transfer hydride ions and effect the reduction of oxygenated functional groups to corresponding hydrocarbon derivatives.

TABLE 2

| | | Aquathermolysis of Pyridine-3-aldehyde (3PyCHO) | | | | | | | | | |
|---|---|---|---|---|---|---|---|---|---|---|---|
| | | Solvent | | | | | | | | | |
| | | $C_6H_{12}$ | | $H_2O$ | | | | | | | |
| | | Additive | | | | | | | | | |
| | | — | $3PyCH_3$ | — | $3PyCH_3$ | HCHO | | $HCO_2H$ | | $H_3PO_4$ | |
| | | Temp (°C.) | | | | | | | | | |
| | | 250 | 250 | 250 | 250 | 200 | 250 | 200 | 250 | 200 | 250 |
| | | Time (h) | | | | | | | | | |
| No. | Structure | 120 | 120 | 120 | 120 | 24 | 120 | 24 | 120 | 24 | 120 |
| 1 | PyH | 0.7 | 0.6 | 52.2 | 15.2 | 7.0 | 52.7 | 2.4 | 6.6 | 2.3 | 84.4 |
| 2 | $3PyCH_3$ | — | 122.4 | 9.7 | 148.4 | 37.0 | 30.5 | 53.0 | 44.8 | 0.2 | 15.5 |
| 3 | 3PyCHO | 99.0 | 76.8 | 27.6 | 25.8 | 0.8 | 1.6 | 1.3 | 0.6 | 88.9 | — |
| 4 | $3PyCH_2OH$ | — | — | 2.1 | 4.9 | 46.7 | 4.1 | 42.9 | 28.9 | 0.2 | — |
| 5 | $3PyCO_2H$ | — | — | — | — | — | — | — | — | 8.4 | — |
| 6 | $3PyCH_2Py3$ | — | — | 3.0 | 1.0 | 3.5 | 4.5 | — | 6.7 | — | — |
| 7 | $3PyCH_2CH_2Py3$ | — | — | 5.4 | 2.0 | 4.9 | 6.4 | — | 12.4 | — | — |

TABLE 2-continued

| | | Aquathermolysis of Pyridine-3-aldehyde (3PyCHO) | | | | | | | | | |
|---|---|---|---|---|---|---|---|---|---|---|---|
| | | Solvent | | | | | | | | | |
| | | $C_6H_{12}$ | | $H_2O$ | | | | | | | |
| | | Additive | | | | | | | | | |
| | | — | $3PyCH_3$ | — | $3PyCH_3$ | HCHO | | $HCO_2H$ | | $H_3PO_4$ | |
| | | Temp (°C.) | | | | | | | | | |
| | | 250 | 250 | 250 | 250 | 200 | 250 | 200 | 250 | 200 | 250 |
| | | Time (h) | | | | | | | | | |
| No. | Structure | 120 | 120 | 120 | 120 | 24 | 120 | 24 | 120 | 24 | 120 |
| 8 | 3PyCH=CHPy3 | — | — | — | 2.6 | — | — | — | — | — | — |

EXAMPLE 6

Various cyanopyridines and pyridine carboxamides listed below in Table 3 were reacted separately in cyclohexane (anhydrous) and in water for five days at 250° C. The results showed cyanopyridines were essentially unreactive in cyclohexane (2.5%), whereas in water these cyano containing groups were completely denitrogenated to pyridine. Likewise, pyridine-2-carboxamide underwent only 2.3% conversion in cyclohexane and quantitative conversion to pyridine in water. The corresponding pyridine carboxamides reacted similarly. The results are summarized below.

TABLE 3

| | % Conversion (250° C., 5 Days) | |
|---|---|---|
| | Cyclohexane | Water |
| 2-Cyanopyridine | 2.5 | 100 |
| 3-Cyanopyridine | 0.9 | 100 |
| 4-Cyanopyridine | 1.5 | 100 |
| Pyridine-2-Carboxamide | 2.3 | 100 |
| Pyridine-3-Carboxamide | 44.6 | 100 |
| Pyridine-4-Carboxamide | 20.9 | 93.9 |

In these reactions, ammonia, formed during the aqueous hydrolysis, served to autocatalyze both the hydrolytic denitrogenation reaction and the subsequent decarboxylation reaction.

EXAMPLE 7

2,5-Dimethylpyrrole underwent 65% conversion during reaction in water for five days at 250° C. Aside from the conversion, two major denitrogenated products formed 3-methylcyclopentenone (46%) and 2,3,4-trimethylindanone (4%). When the reaction was carried out in water that contained one mole equivalent of phosphoric acid, complete conversion (100%) of the 2,5-dimethylpyrrole was obtained. The example illustrates that because of the extra acidity, 3-methylcyclopentenone was a minor product (3%) and the major products were methylated indanones.

EXAMPLE 8

2-Methylpyridine was added to water, along with one equivalent of phosphoric acid. The mixture was reacted for 3 days at 350° C. and 24.7% conversion was obtained. The major denitrogenated products were phenols, benzene, p-xylene and ethylbenzene and accounted for 10% of the overall conversion.

Examples 7 and 8 illustrate that water at 350° C. can act as an acid catalyst and effect the denitrogenation of heterocyclic compounds. For instance, in Example 7, when the acidity of the water was increased slightly by the addition of one mole equivalent of phosphoric acid, the initial product, 3-methylcyclopentenone condensed with a molecule of starting material was obtained after the ammonia and indanone were eliminated.

EXAMPLE 9

Benzothiophene was added to water, along with one equivalent of phosphoric acid. The mixture was reacted for 5 days at 350° C. and a 27.5% conversion was obtained. The major desulfurized products were ethylbenzene and toluene, which combined, accounted for 17.0% of the overall conversion.

The example illustrates that water can effect the desulfurization of sulfur containing heterocyclic compounds.

EXAMPLE 10

A series of sulfur model compounds were reacted in water and water containing clay (nontronite) for 3 days at 300° C. We found that hydrogen sulfide ($H_2S$) is generated from mercaptans (R—SH) directly and also indirectly from the conversion of disulfides (R—S—S—R) and sulfides (R—S—R) to mercaptans under the following scheme:

$$R—S—S—R \rightarrow R—SH \rightarrow R—S—R + H_2S$$
$$R—S—R \rightarrow R—SH + RH \rightarrow R—S—R + H_2S$$

TABLE 4

| | % Conversion | |
|---|---|---|
| Compounds | Water | Water + Clay (Nontronite) |
| $C_{10}H_{21}SH$ | 70 | 78 |
| $C_8H_{17}SC_8H_{17}$ | 18 | 65 |
| $C_{10}H_9SH$ | 87 | 94 |
| $C_{10}H_9SC_8H_{17}$ | 90 | 93 |

The results in Table 4 clearly illustrate that the sulfided compounds have higher reactivity in water containing a clay mineral catalyst (Nontronite).

EXAMPLE 11

Benzonitrile and benzamide were reacted separately in cyclohexane (anhydrous) and in water at 250° C. for 5 days. In cyclohexane, benzonitrile underwent 2% conversion, whereas in water it underwent complete conversion to benzamide (14%) and benzoic acid (86%). Benzamide was partially dehydrated in cyclohexane to yield benzonitrile (28%) and water produced by this reaction hydrolyzed some of the unreacted benzamide to benzoic acid (3%). The remainder was unreacted. In water benzamide underwent 82% conversion to benzoic acid.

The example illustrates the hydrolytic denitrogenation of an aromatic nitrile and amide in an aqueous environment. Autocatalysis by the basic hydrolysis product ammonia facilitates the reaction.

EXAMPLE 12

Several aniline derivatives were reacted for 3 days at 250° C. in (a) cyclohexane (used as a thermal agent), (b) water and (c) water containing a brine (a mixture of one equivalent of sodium sulfite in a saturated aqueous sodium bisulfite solution). None of the reactants underwent conversion in the cyclohexane and there was no reactivity in the water. However, the results, summarized in Table 5 below, show that the brine serves as an oxidizing reagent and facilitates denitrogenation of the anilines and the subsequent conversion of these reactants to their corresponding phenols.

TABLE 5

| Reactant | Major Products with Aqueous Sulfite/Bisulfite | (% Conversion) |
|---|---|---|
| o-Toluidine | o-Cresol | (22.9%) |
| p-Toluidine | p-Cresol | (30.7%) |
| 4-Ethylaniline | 4-Ethylphenol | (64.8%) |
| | 4,4'-diethyldiphenylamine | (19.6%) |
| 4-i-Propylaniline | 4-i-Propylphenol | (18.9%) |
| | 4,4'-di-i-propyldiphenylamine | (9.3%) |

EXAMPLE 13

Several ethers and a thioether were reacted for 3 days at 250° C. in cyclohexane, in water and in water containing a mixture of one equivalent of sodium sulfite in a saturated aqueous sodium bisulfite solution. The results, summarized in Table 6 below, show that cyclohexane and water conversions are relatively low, but addition of aqueous sulfite/bisulfite facilitated the cleavage of the ether and thioether carbon to oxygen and carbon to sulfur bonds to form phenol and thiophenol as the major products.

TABLE 6

| | % Conversion | | |
|---|---|---|---|
| Reactant | Cyclohexane | Water | Aqueous Sulfite/Bisulfite |
| Anisole | — | 1.3 | 27.4 |
| n-Butyl Phenyl Ether | — | 0.8 | 80.9 |
| 2,3-Dihydrobenzofuran | 4.2 | 3.8 | 76.5 |
| Thioanisole | 0.1 | 0.1 | 24.6 |

EXAMPLE 14

A kerogen concentrate of Green River oil shale (95% organic) was prepared by contacting the shale with HCl and HF at room temperature. One sample of the kerogen concentrate was reacted in water for 32 days at 250° C. while a second sample was reacted in water for 4 hours at 300° C. The results of the two experiments were measured by comparing the extractabilities of the THF kerogen before and after treatment in each case. The first sample (32 days @ 250° C.) showed a 14.9% increase in extractibility and the second (4 hours @ 300° C.) a 23.1% increase. The example illustrates the water depolymerizes oil shale kerogen by cleaving the key crosslinks holding the macromolecular structure together.

The above examples are presented by way of illustration. The various components of the catalyst systems described therein do not possess exactly identical effectiveness. As such, the most advantageous selection of catalyst components, concentrations and reaction conditions depend greatly on the particular feed being processed. Having set forth the general nature and specific examples of the present invention, the scope of the invention is now particularly pointed out in the subjoined claims.

What is claimed is:

1. A process for converting and upgrading organic resource materials to produce more desirable, value added materials comprising contacting an organic resource material selected from the group consisting of coal, shale, coal liquid, shale oils, heavy oil and bitumens with liquid water in the absence of externally supplied hydrogen and reducing agents, in the presence of an acid catalyst selected from the group consisting of brine, clay and mixtures thereof; controlling the temperature in a range from above about 200° C. to below the critical temperature of water to maintain the water in a liquid phase, wherein the pressure is the autogeneous vapor pressure generated in the system; and continuing said contacting for a time sufficient to effect said conversion and upgrading.

2. The process of claim 1 wherein the brine catalyst is selected from salt solutions consisting of Na, K, Ca, Mg, Fe cations and mixtures thereof and water soluble anions bondable with the cation.

3. The process of claim 1 wherein the clay catalysts are selected from illitic clays and smectitic clays and mixtures thereof.

4. The process of claim 1 wherein the water is substantially free of dissolved oxygen.

5. The process of claim 1 wherein the weight ratio of water to organic resource material is about 0.5 to about 10.0.

6. The process of claim 5 wherein the weight ratio is about 0.5 to about 5.0.

7. The process of claim 2 wherein the organic resource material has a maximum particle diameter ranging from about 0.25 inches to 100 Tyler mesh.

8. The process of claim 7 wherein the maximum particle diameter ranges from about 60 to about 100 Tyler mesh.

9. The process of claim 1 wherein said catalytically effective amount of catalyst is equivalent to a concentration level in water in the range from about 0.01 to about 15 weight percent.

10. The process of claim 9 wherein said catalytically effective amount of catalyst is equivalent to a concentration level in water in the range of about 0.1 to about 10 weight percent.

11. The process of claim 1 further comprising contacting the products obtained in claim 2 with the organic resource material and thereby effect further conversion and upgrading.

12. The process of claim 1 wherein the water is neutral water.

13. A process for converting and upgrading oil shale to produce more desirable, value added materials, comprising the steps of treating the oil shale to produce a kerogen concentrate; contacting the kerogen concentrate with liquid water, in the absence of externally supplied hydrogen and reducing agents in the presence of an acid catalyst, selected from the group consisting of brine, clay and mixtures thereof; controlling the temperature in the range from above about 200° C. to below the critical temperature of water to maintain water in a liquid phase, wherein the pressure is the autogeneous vapor pressure generated in the system; and continuing the contacting from 10 minutes to 6 hours thereby producing products with increased extractability.

* * * * *